United States Patent [19]

Tanigawa

[11] 4,262,286

[45] Apr. 14, 1981

[54] APPARATUS FOR MONITORING FIRE AND EFFECTING CONTROL OPERATION

[75] Inventor: Takeshi Tanigawa, Machida, Japan

[73] Assignee: Hochiki Corporation, Tokyo, Japan

[21] Appl. No.: 914,760

[22] Filed: Jun. 12, 1978

[30] Foreign Application Priority Data

Jun. 13, 1977 [JP] Japan ..... 52-68819

[51] Int. Cl.[3] ..... G08B 17/00

[52] U.S. Cl. ..... 340/584; 169/61; 340/502; 340/518; 340/577; 340/600

[58] Field of Search ..... 340/518, 525, 502, 505, 340/584, 577, 600; 169/61

[56] References Cited

U.S. PATENT DOCUMENTS

| | | | |
|---|---|---|---|
| 2,786,988 | 3/1957 | Bergman | 340/518 |
| 3,940,739 | 2/1976 | Quimet | 340/518 |
| 4,032,908 | 6/1977 | Rice et al. | 340/518 |

*Primary Examiner*—Glen R. Swann, III

*Attorney, Agent, or Firm*—Robert E. Burns; Emmanuel J. Lobato; Bruce L. Adams

[57] ABSTRACT

Apparatus for monitoring fire and effecting indication and control operations comprises a matrix monitoring signal line network comprising vertical lines and horizontal lines. A plurality of sensing blocks are connected between vertical lines and horizontal lines of the network. Each of the sensing blocks comprises a sensor connected to a power supply. A monitoring circuit having a switch controlled by the sensor and a diode of forward direction in series with the switch is connected between the respective vertical line and horizontal line of the network. An operating circuit connected in parallel with the monitoring circuit comprises a relay connected in series with a second diode of reverse direction. The horizontal lines and vertical lines of the network are sequentially scanned by a circuit including a counter and demultiplexer. When the scanning detects a short circuit produced by operation of a sensor and respective monitoring circuit, the polarity of the vertical and horizontal lines of the network are reversed and this results in operation of the operating circuit to activate an indicator and any accessory controls such as door closers and the like. After reversal of polarity, the network is again scanned and normal polarity of the network is thereafter restored.

7 Claims, 12 Drawing Figures

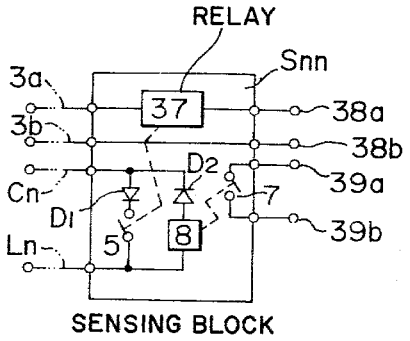
FIG. 5
FIG. 3
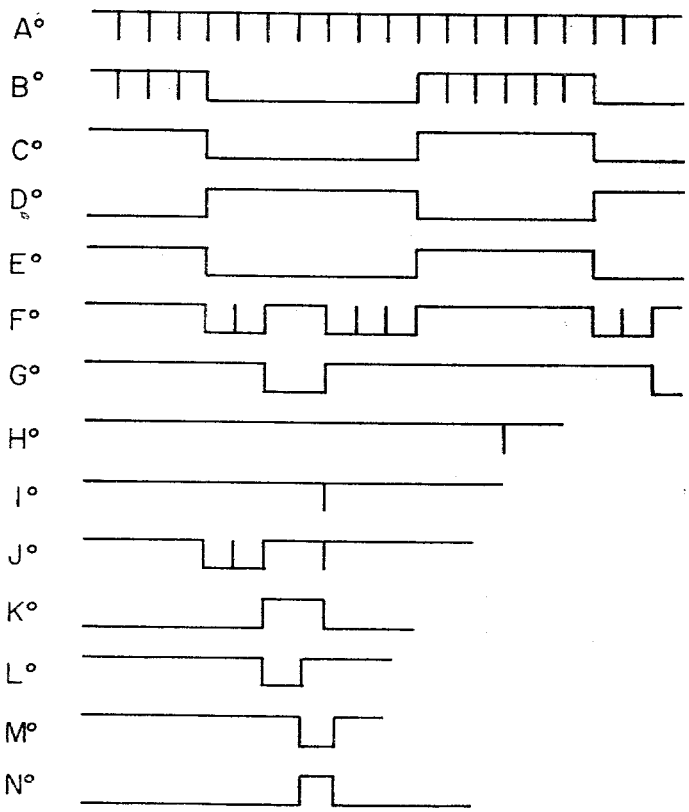

Z
DC SOURCE g'3
g'2
g2
g3
105
g'1
g1
m
m'
E0
a0
a3
108
109
c0
115
c3
106
107
CONTROLLER
SENSER
c9
E9
a9
112
110
F0
l0
l2
l0
l2
111
l9
F9
l9
c'3
l'2
c'0
c'9
l'0
l'9
b0
122
123
S0
T0
SN74154
121
S9
T9
A
B
C
D
G
0
9
15
b9
U0
124
125
f0
d0
V0
U9
d9
V9
f9
114
h
GATE
RELAY
113

APPARATUS FOR MONITORING FIRE AND EFFECTING CONTROL OPERATION

BACKGROUND OF THE INVENTION

The present invention relates to an apparatus for monitoring fire and effecting control operation, having a monitoring function for examining which one of the sensors has detected fire, and a control function for operating various devices installed in a region to which is allocated said sensor which has detected fire. More specifically, the present invention relates to an apparatus for monitoring fire and effecting a control operation, including a matrix circuit used for producing a monitoring function, and a polarity-reversing switch means installed in a power-feeding line of said matrix circuit so that a control function is produced after the polarity of a power supply is reversed owing to the monitoring function.

There has not so far been known apparatus in which a one-way electric current flowing into a matrix-type monitoring circuit is caused to flow in a reverse direction in order to examine which one of a number of terminal devices is functioning as well as to produce other functions, the output ends of such terminal devices being connected between pairs of vertical lines and horizontal lines of the matrix consisting of vertical lines and horizontal lines.

SUMMARY OF THE INVENTION

A primary object of the present invention is to provide an apparatus for monitoring fire and effecting a control operation, having a small number of circuits consisting of a matrix monitoring signal line network in which the output ends of the sensors are connected between pairs of vertical lines and horizontal lines, and having means for reversing the polarity of the power supply which supplies electric power to said matrix monitoring signal line network, so that accessory devices can be operated by an electric current of which the polarity is reversed and caused to flow in a reverse direction as a result of the monitoring operation.

Another object of the present invention is to provide an apparatus for monitoring fire and effecting a control operation, composed of a matrix signal line network, in which a monitoring circuit having switch means that will be closed by the output of the sensor and a diode of a forward direction that are connected in series between pairs of vertical lines and horizontal lines of said matrix signal line network, is connected in parallel with an operation circuit having control means for operating accessory devices and a diode of a reverse direction connected in series with said control means, so that two electric currents of different directions will flow selectively.

A further object of the present invention is to provide an apparatus for monitoring fire and effecting a control operation, consisting of a switch means connected to each of the vertical (or horizontal) lines of a matrix monitoring line network connected across output terminals of a power supply to which is connected a polarity-reversing switch means for reversing the polarity, a scanning circuit which produces outputs for successively operating said switch means, and a second scanning circuit for detecting the output of monitoring lines produced by the short-circuiting power supply when said switch means contained in the conductive monitoring lines has received an output from said scanning circuit, wherein the output of said monitoring lines and the output of said second scanning circuit actuate said polarity-reversing switch means to feed an electric current of a reversed direction to said monitoring lines.

A still further object of the present invention is to provide an apparatus for monitoring fire and effecting a control operation, comprising a scanning circuit for detecting the presence or absence of a conductive state between pairs of lines by drawing the power-supply lines leading to a plurality of sensors from a receiving device as separate lines, drawing lines consisting of a plurality of pairs of vertical lines and horizontal lines which serve both as monitoring signal lines and control lines in the form of a matrix from said receiving device, connecting, in parallel between the individual pairs of said vertical lines and horizontal lines, a series circuit consisting of a switching device which will be rendered conductive when any one of said sensors is operated and a diode of a forward direction and a series circuit consisting of a control unit and a diode of a reverse direction, whereby said receiving device successively scans the vertical lines and horizontal lines thereby to detect the presence or absence of a conductive state among each of the pairs of lines; an indicator circuit which discriminates and indicates the position of the sensor which has operated from the combination of vertical and horizontal lines based upon said detected results; a polarity-reversing circuit which temporarily stops the scanning of said scanning circuit at a place in which is present the sensor which has operated and reverse the polarities of the vertical and horizontal lines to actuate a control unit between said lines; and a control circuit which returns said reversed polarities to the initial state and resumes said scanning when a confirmation signal produced by a contact which confirms the operation of said control unit is received via a confirmation line or when a predetermined period of time has passed.

BRIEF DESCRIPTION OF THE DRAWINGS

FIG. 3 is a time chart which shows the operation of an apparatus of FIG. 1;

FIG. 5 is a block diagram which shows a modification of the present invention;

DETAILED DESCRIPTION OF PREFERRED EMBODIMENTS OF THE INVENTION

An embodiment of the present invention diagramatized in FIG. 1 to FIG. 4 is described below.

Figures 1, 2:
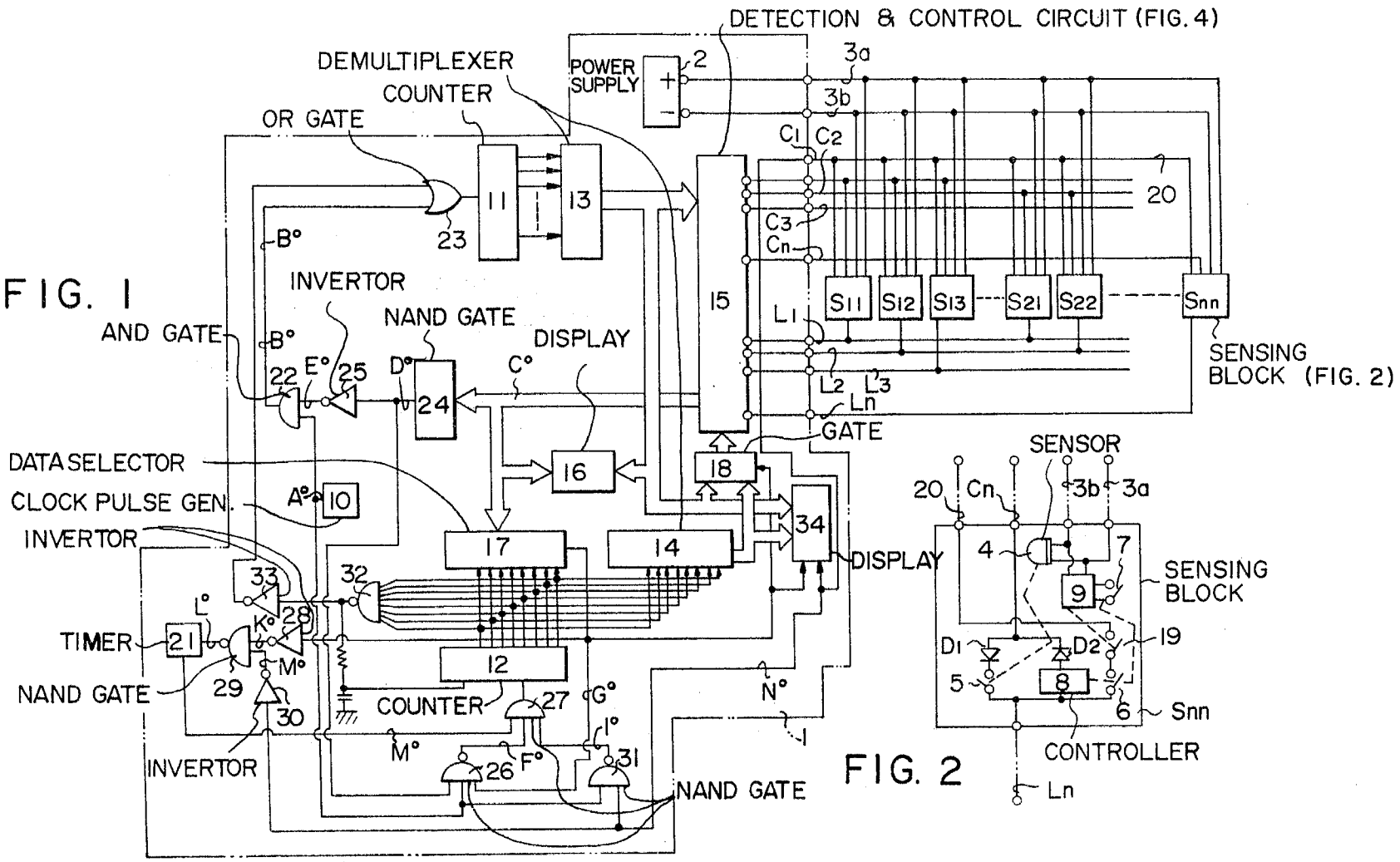
FIG. 1 is a block diagram which shows an embodiment according to the present invention.
FIG. 2 is a block diagram which concretely shows an important portion of FIG. 1.

FIG. 1 is a block diagram schematically showing an apparatus for monitoring fire, in which independent power-supply wires 3*a* and 3*b* are drawn from a power supply 2 of a receiving device 1 and are connected to a sensor which will be described later. From said receiving device 1 are drawn a plurality of vertical lines $C_1$, $C_2$, $C_3$,–$C_n$ and horizontal lines $L_1$, $L_2$, $L_3$,—$L_n$ which serve both as monitoring signal lines and control lines, and sensor blocks $S_{11}$, $S_{12}$, $S_{13}$,–$S_{nn}$ are connected between each pair of vertical lines and horizontal lines constituting the aforesaid vertical and horizontal lines. All of these sensor blocks have the same performance and each comprises a sensor 4, a switching device 5 which will be actuated when said sensor is operated, a control unit 8 made up of a relay having contacts 6, 7, and a control unit 9 made up of a relay having contact 19 connected to said power-supply lines 3*a*, 3*b* and operated when the operation of said control unit 9 itself is completed, as exemplified with reference to the sensor block $S_{nn}$ diagramatized in FIG. 2.

Said control unit 9, if it is of a small power capacity, may be operated directly instead of through the control unit 8.

Between said vertical line and horizontal line (between line $C_n$ and line $L_n$ in the case of FIG. 2) are connected in parallel a series circuit of said switching device 5 and a diode $D_1$ of a forward direction and a series circuit of said control unit 8 and a diode $D_2$ of a reverse direction. The aforesaid receiving device has a scanning circuit which successively scans each of the vertical and horizontal lines $C_1$, $C_2$, $C_3$,—$C_n$ and $L_1$, $L_2$, $L_3$,—$L_n$ to detect the presence or absence of a conductive state between the lines of each pair, and is constituted by means of a clock pulse oscillator 10, counters 11 and 12, demultiplexers 13 and 14, and a detection control circuit 15. Said receiving device further has an indicator circuit 16 which discriminates and indicates the position of the operated sensor from the combination of vertical and horizontal lines based on said detected result, and a polarity-reversing circuit which temporarily stops the scanning of said scanning circuit at a place where the operated sensor is located and drives the control unit 8 between the vertical and horizontal lines by reversing the polarities of said lines. The polarity-reversing circuit consists of a data selector 17, a gate 18 and said detection control circuit 15. Said receiving device further possesses a control means which returns said reversed polarities to the initial state and resumes said scanning operation when a confirmation signal produced by a contact 19 which confirms the operation of the control unit 9 is received via a confirmation line 20, or when a given period of time determined by a timer 21 has passed. The control means consists of the counter 12 and detection control circuit 15.

With the aforesaid apparatus for monitoring fire, clock pulses diagramatized by curve A° in FIG. 3 produced by the oscillator 10 during the monitoring period are supplied to the counter 11 via an AND gate 22 and OR gate 23, whereby said counter is operated and scanning signals are obtained from the demultiplexer 13. The clock pulses which have passed through said AND gate. When scanning signals are received from the demultiplexer 13, the clock pulses have a logic level "0": otherwise the logic level is "1." Depending upon the outputs of the demultiplexer 13, said detection control circuit 15 successively supplies the electric power to the lines $C_1$, $C_2$, $C_3$,–$C_n$. Under ordinary condition, the switching devices 5 of the sensors 4 of sensor blocks $S_{11}$ to $S_{nn}$ are not closed, and the scanning is performed continuously. When said sensor 4 is operated and the switching device 5 is closed, an electric current flows into the vertical and horizontal lines to which is connected said switching device. The detection control circuit 15 detects on which pairs of lines the electric current has increased. The detected output is diagramatized by curve C° in FIG. 3, whereby said lines have a level "0", and other lines have a level "1".

Owing to this output, the output of a NAND gate 24 turns from "0" to "1" as diagramatized by curve D° in FIG. 3, and the output D° of said NAND gate is reversed by an inverter 25 and acquires a pattern as shown by curve E° in FIG. 3. The output E° is supplied to the AND gate 22. When the output E° is "0" as shown in FIG. 3, the clock pulses as shown by curve B° are not supplied to the counter 11; the operation of the counter 11 is stopped. At this time, a place at which the alarm was produced is indicated on an indicator circuit 16 owing to the output of the demultiplexer 13 and the output C° of the detection control circuit 15. A "0" input is fed to the other input terminal of the OR gate 23 to which has been fed said output B°. The output D° of a NAND gate 24 is fed to a NAND gate 26 which produces outputs of reversed clock pulses A° of the oscillator 10 as shown by curve F° in FIG. 3. At this moment, the output of the data selector 17 is "1" as diagramatized by curve G° in FIG. 3. The output F° of said NAND gate 26 is supplied to the counter 12 via an AND gate 27 and counted. The output of the timer 21 fed to the AND gate 27 at this time is "1" as diagramatized by curve H° in FIG. 3, and the output of a NAND gate 31 to which are fed a signal from the confirmation line 20 and clock pulses A° from the oscillator 10, is "1" as diagramatized by curve I° in FIG. 3. The output of said counter 12 is as diagramatized by curve J° in FIG. 3. The data selector 17 is operated by the output J° and scans the outputs of said detection control circuit 15. The output G° on said lines as "0", whereby the output F° of the NAND gate 26 turns from pulses to a level "1" causing said counter 12 to be stopped. The output G° of said data selector 17 is converted by an inverter 28 as shown by curve K° in FIG. 3; the output K° is fed to the NAND gate 29 whereby an output shown by curve L° in FIG. 3 is obtained. To said NAND gate 29 is fed an output (shown as curve M° in FIG. 3) of an inverter 30 mentioned later. Said output G° is further fed to gate 18. When said output G° is "0", the outputs at a place where the scanning of the demultiplexer 13 has stopped and at a place where the scanning of the demultiplexer 14 has stopped, are fed to the detection control circuit 15 to reverse the polarities of the corresponding lines.

For example, if the subject lines are $C_1$ and $L_2$, the polarities are changed from $C_1(+)$, $L_2(-)$ into $C_1(-)$, $L_2(+)$. The electric current flows through said control unit 8 and diode $D_2$, the contacts 6 and 7 are closed by the operation of said control unit, the control unit 9 consisting of a relay is operated by the closure of the contact 7, the contact 19 is closed by the completion of said operation, whereby the line $L_2$ and the confirmation line 20 are connected by said contacts 6 and 19, and the confirmation line 20 in the receiving device 1 acquires a level "1" as shown in curve N° FIG. 3. If the output N° becomes "1", the output I° of NAND gate 31 to which will be applied said output N° and said clock pulses A° produce pulses of sign "0", and a bit of said pulse steps up the counter 12. When there is no detected output C° in the detection control circuit 15, the output G° of the data selector 17 becomes "1", whereby the gate 18 interrupts the passage of signals and the polarity of said line is returned to positive. At this moment, no electric current is passed to the control unit 8, the contacts 6 and 7 are opened, said output N° becomes "0", and the output I° of the NAND gate 31 becomes "1". The output G° of the data selector 17 becomes "0", and the output F° of the NAND gate 26 takes the form of pulses which actuate the counter 12 via the AND gate 27. The data of lines $L_3$ to $L_n$ are scanned by the data selector 17. If any one of said sensors 4 is working, the operation of the counter 12 is stopped as mentioned already, polarities of the lines are reversed to actuate the control unit 8, and thereafter the counter 12 is operated again. When the counting operation of said counter 12 is completed, the output of the NAND gate 32 is changed from "0" to "0", whereby the counter 12 is reset and the output of the NAND gate 32 returns to "1". The output of said NAND gate 32 is fed to the counter 11 via the inverter 33 and said OR gate 23; said counter is stepped up to monitor the line $C_2$.

When the output N° is not obtained from said confirmation line 20, the counter 12 is operated after a predetermined period of time set by the timer 21 has passed. That is, the timer 21 is operated with an input "0", restored with an input "1". Under ordinary condition, the output is "1" and, after a predetermined period of time has passed, the output is "0", and the output "1" is produced again. Here, if the counter is stopped at a place where the sensor 4 has worked as mentioned above, and the output G° of the data selector 17 becomes "0", the output G° is fed to the inverter 28 and to the NAND gate 29 whereby the output L° ("0") is fed to the timer 21. The output M° at this moment is "1". Said timer 21 is actuated by the input "0", and after a predetermined period of time has passed, the output H° becomes "0" instantaneously and then assumes "1". Said output H° is fed to a counter 12 via said AND gate 27, and said counter is advanced by one step to acquire the next operation and repeats the aforementioned operation.

Without the aforesaid timer 21, if the output N° is not obtained from the confirmation line 20, the counter 12 is maintained in a stopped state making it impossible to monitor other sensors 4.

Reference numeral 34 represents an indicator circuit which works to flash an indicator for confirming the operation of controlled units (fire-preventing doors or the like) corresponding to the sensors, based on the outputs of demultiplexers 13, 14 and data selector 17. If the polarity of the detection control circuit 15 is reversed by the output of the gate 18 causing the control unit 8 to operate and if the output N° is obtained from the confirmation line 20, the indicator of the indicator circuit 34 which had been flashing by the output N° is turned on to indicate that the control operation is completed. When the output N° is not obtained, the counter 12 is operated by said timer 21 to start the scanning. In this case, the indicator is not turned on but remains flashing to indicate that the control operation is not completed. When the scanning is started by said timer 21, if the output N° is not obtained from the confirmation line 20 with lines $C_2$ and $L_2$, the lines $L_2$ to $L_n$ are scanned and thereafter the lines $C_2$,-$C_n$, $C_1$, $C_2$ are scanned, and the scanning operation is ceased. Similarly, the lines $L_2$-$L_n$, $L_1$, $L_2$ are scanned and the scanning is ceased. Thereafter, the polarity is reversed, and the operation of said control unit 4 is repeated.

Figure 4:
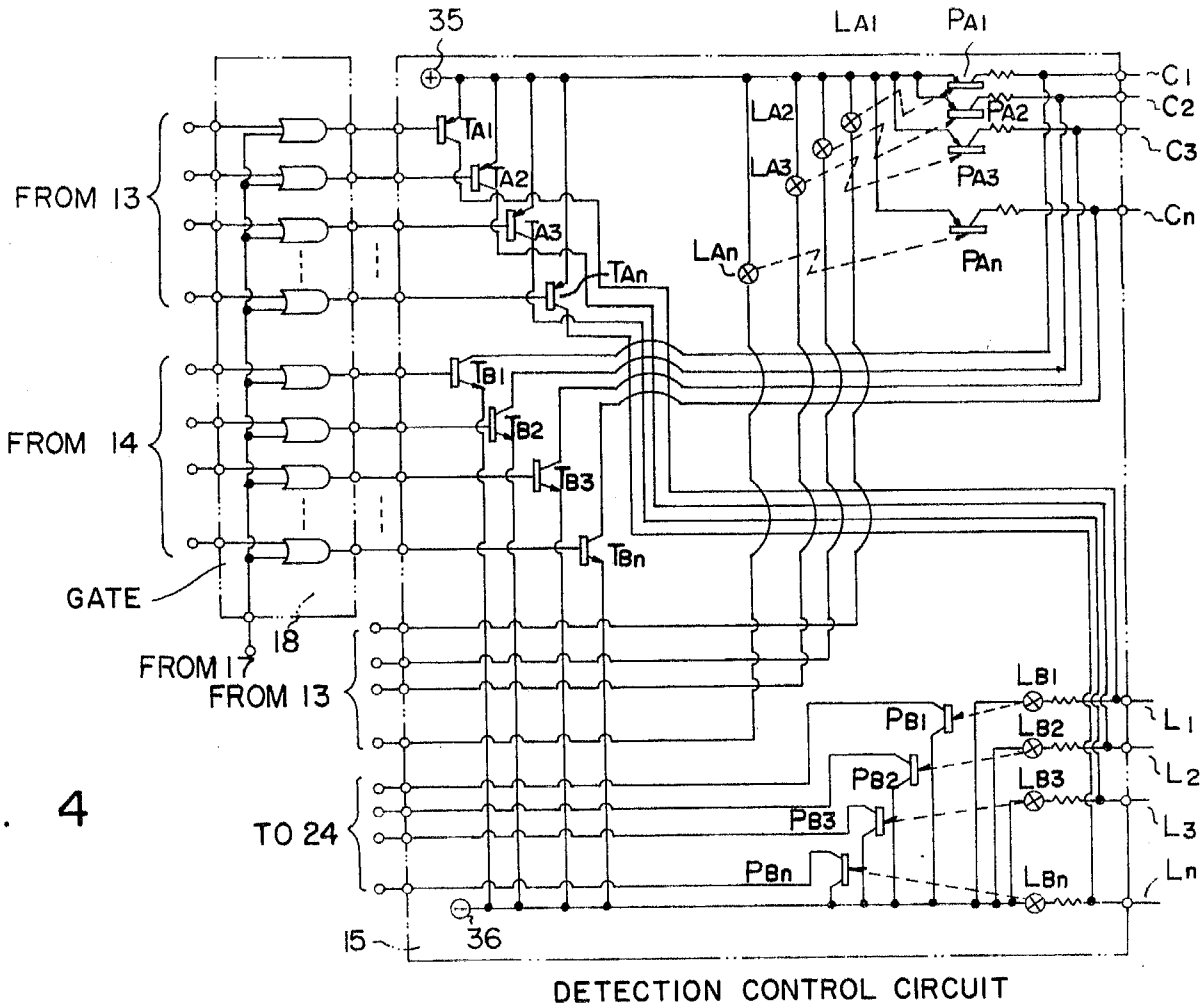
FIG. 4 is a circuit diagram which concretely shows an important portion of FIG. 1.

FIG. 4 concretely shows said detection control circuit 15 and gate 18, in which light emitters $L_{A1}$, $L_{A2}$, $L_{A3}$,-$L_{An}$ are successively turned on by the output of a level "1" of said demultiplexer 13. The light receivers $P_{A1}$, $P_{A2}$, $P_{A3}$,-$P_{An}$ optically coupled to these light emitters are also rendered conductive successively responsive to the turn on of said light emitters, and the voltage is successively supplied to said lines $C_1$, $C_2$, $C_3$, —$C_n$ from a positive terminal 35 of the power supply to perform the scanning. Further, if the switching device 5 is closed by the operation of said sensor 4, the lines of each pairs consisting of lines $C_1$, $C_2$, $C_3$, —$C_n$ and $L_1$, $L_2$, $L_3$, —$L_n$ are short-circuited with a low impedance, whereby among the light emitters $L_{B1}$, $L_{B2}$, $L_{B3}$, —$L_{Bn}$, the light emitters corresponding to the short-circuited lines are turned on. Accordingly, among the light receivers $P_{B1}$, $P_{B2}$, $P_{B3}$, —$P_{Bn}$, the light receivers corresponding to the turned-on light emitters are rendered conductive; the output of the turned-on light receivers becomes "0" and is fed to said NAND gate 24. To said gate 18 are fed the output G° from the data selector 17 and the outputs of the demultiplexers 13 and 14. Owing to these outputs, the transistors $T_{A1}$, -$T_{An}$ and $T_{B1}$-$T_{Bn}$ corresponding to the lines $C_1$, -$C_n$, $L_1$, -$L_n$ of the functioned sensors 4, are actuated.

With these transistors being rendered conductive, for example, with the transistors $T_{A1}$ and $T_{B2}$ being rendered conductive, an electric current of which polarity was reversed flows into a negative terminal 36 via said transistor $T_{A1}$, line $L_1$, control unit 8, diode $D_2$, line $C_2$ and transistor $T_{B2}$, to actuate the control unit 8 as mentioned earlier.

Unlike the aforementioned embodiment having a sensor 4 between each pair of vertical lines and horizontal lines, the embodiment may also be so modified as diagramatized in FIG. 5 wherein a relay 37 is inserted in series with said power-supply line 3*a* as a sensor block, for example, as a sensor block $S_{nn}$, a plurality of sensors are connected in series with the terminals 38*a*, 38*b* of power-supply lines 3*a*, 3*b* via said relay 37, so that said relay 37 is energized when at least any one of said sensors is actuated thereby to operate said switching device 5.

Referring to FIG. 5, the reference numerals the same as those of FIG. 2 denote the same members. Reference numerals 39*a*, 39*b* denote terminals connected to a plurality of releases; the releases are actuated by the closure of said contact 7. In the aforementioned embodiment, since the power-supply lines were provided separately, the power supply to the sensors during the scanning and controlling operations can be prevented from being interrupted, the ionic-type or photoelectronic-type smoke sensors can be monitored, the monitoring signal lines and control lines can be used commonly, the monitoring and controlling operations can be performed separately without being intermingled together, the degree of fire spread can be learned, and the controlling operation can be taken responsive to the degree of fire spread.

The addition of a confirmation line further enables the operation of the controlled devices to be confirmed.

Figure 6A:
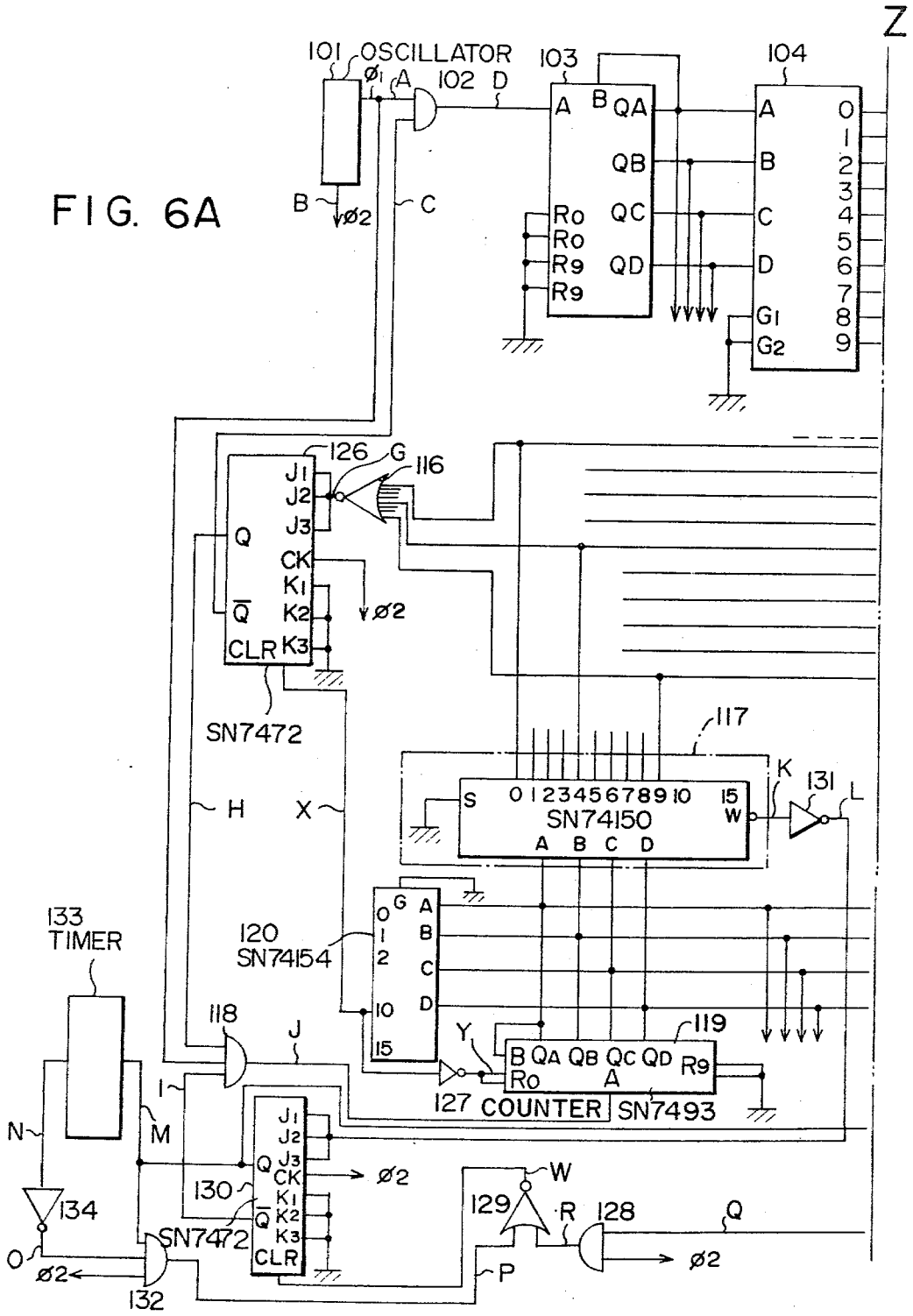
FIG. 6A and FIG. 6B together show an electric circuit diagram of a further embodiment of the present invention, the two figures joining one another on the line Z-Z.
Figure 6B:
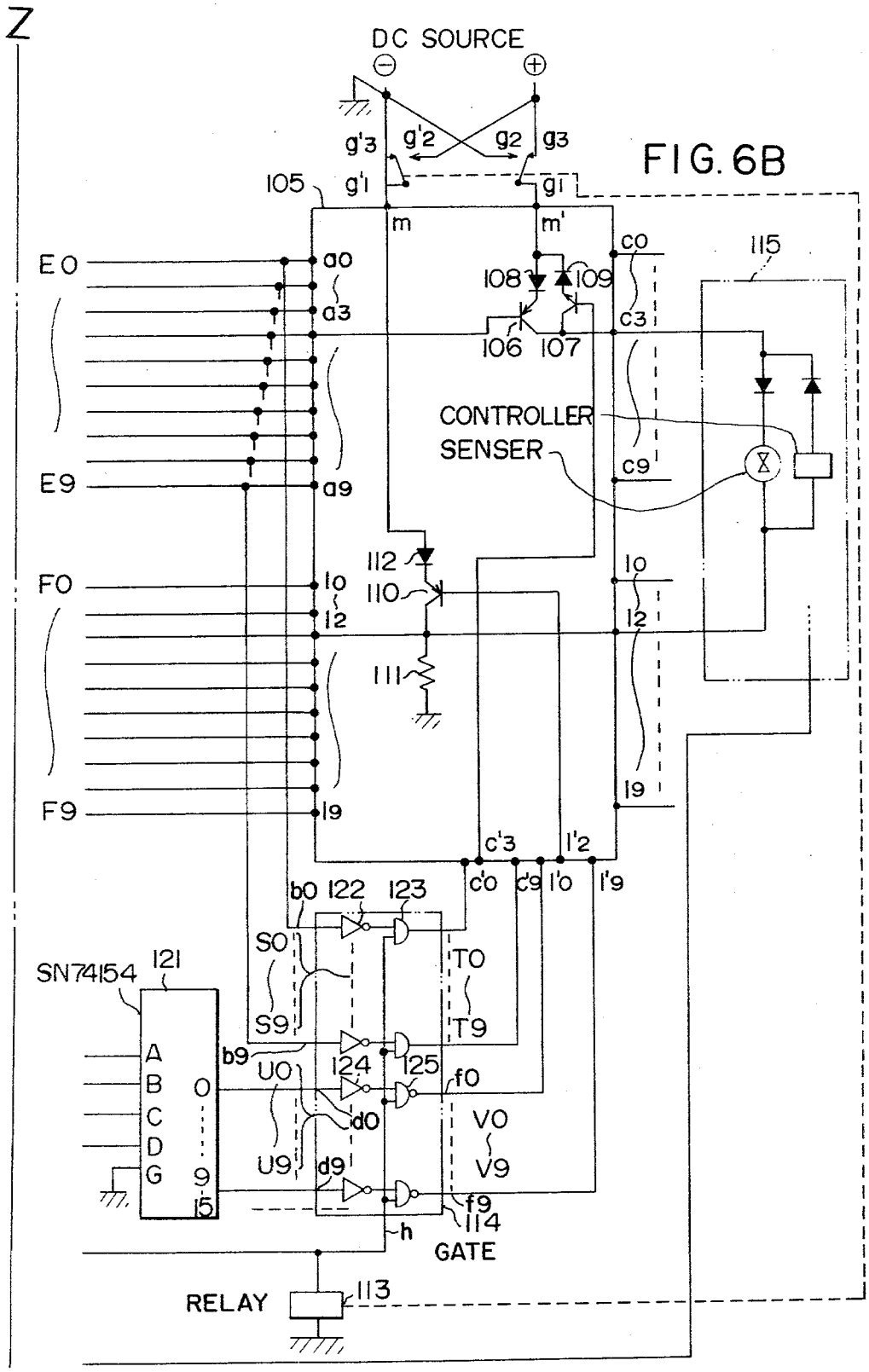
Figure 7A:
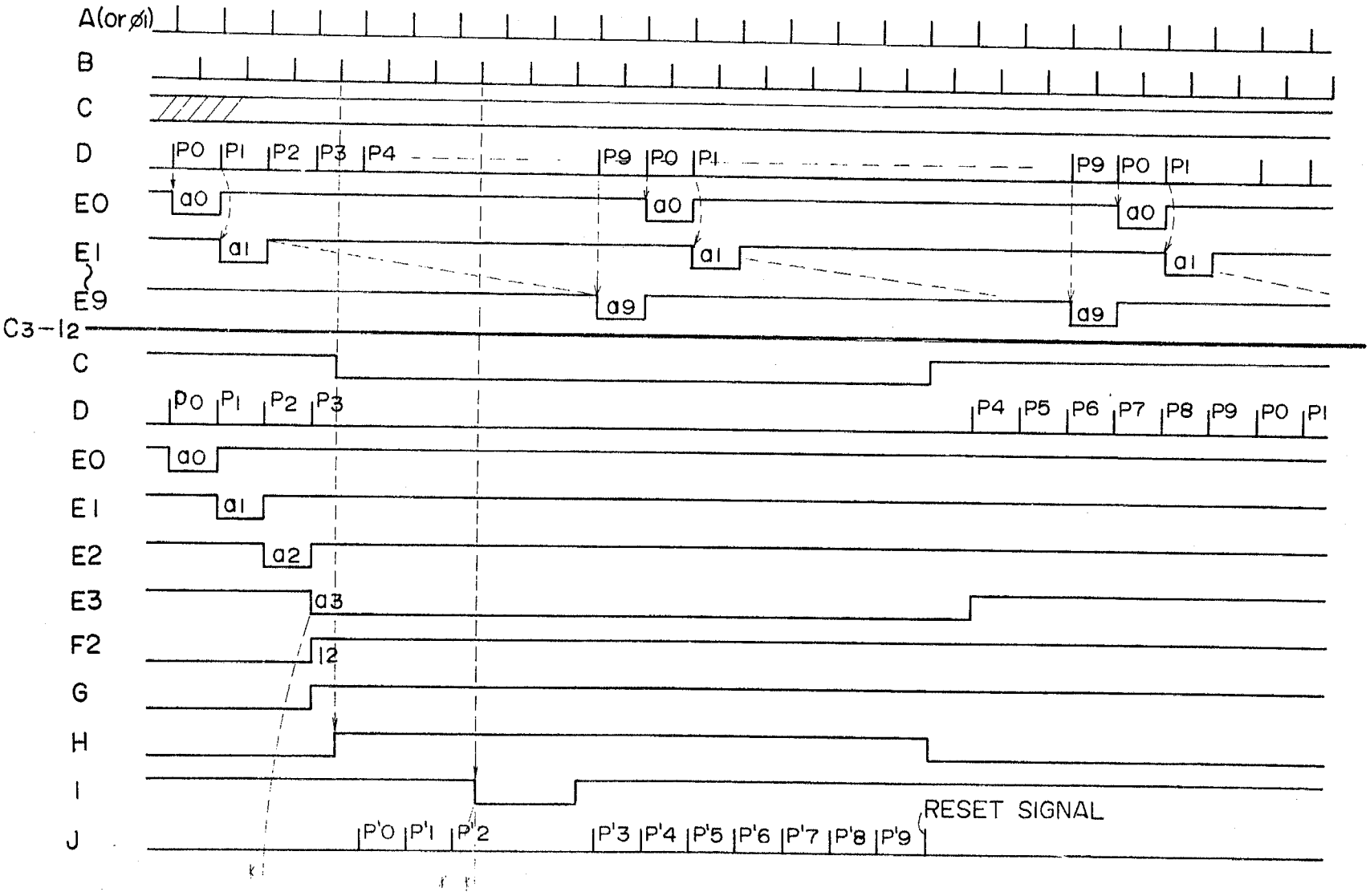
FIG. 7A and FIG. 7B show a time chart for illustrating the operation of a circuit shown in FIGS. 6A-6B.
Figure 7B:
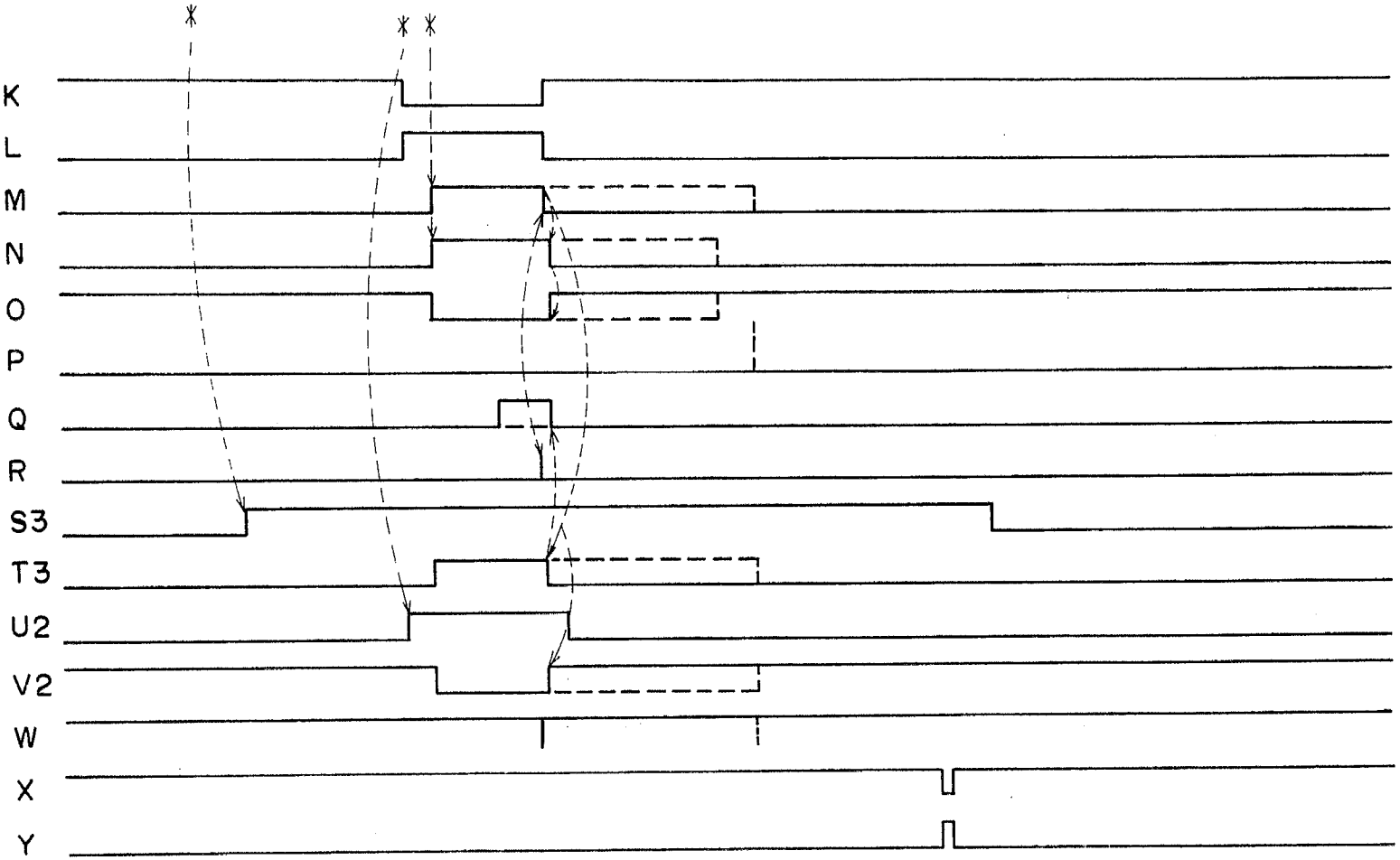

A further embodiment of the present invention is shown in FIGS. 6A, 6B and a time chart illustrating the operation of this embodiment is shown in FIGS. 7A, 7B.

The output (wave form A) of a clock pulse oscillator 101 is supplied to an input terminal of an AND gate 102, and the output terminal (wave form D) of the AND gate 102 is connected to the input terminal of a decoder counter 103 (Ser. No. 7490). The output terminals of the decoder counter 103 are connected to input terminals of a demultiplexer 104 (Ser. No. 74154) and to an indicator circuit. Terminals 0 to 9 (wave forms E0 to E9) of the demultiplexer 104 are connected to the terminals a0 to a9 of a detection control circuit 105 (FIG. 6B) and to terminals b0 to b9 of a gate circuit 114.

The contents of the detection control circuit 105 are illustrated with reference to a circuit connecting terminals a3, m′, c3, c′3 and a circuit connecting terminals m, l2, l′2. The terminal a3 is connected to the base of a transistor 106, and the collector of the transistor 106 is connected to the collector of a transistor 107 and to the terminal c3. The emitter of the transistor 106 is connected to a diode 108, and the other terminal of the diode 108 is connected to the terminal m′ and to a diode 109. The other terminal of the diode 109 is connected to the emitter of the trnsistor 107, and the base of the transistor 107 is connected to the terminal c′3. There are ten such similar circuits starting from a circuit connecting terminals a0, m′, c0, c′3 up to a circuit connecting the terminals a9, m′, c9, c′9.

The terminal l2 is connected to the collector of a transistor 110 and to a resistor 111, and the other terminal of the resistor 111 is grounded. The terminal m is connected to a diode 112, and the other terminal of the diode 112 is connected to the emitter of the transistor 110. The base of the transistor 110 is connected to the terminal l′2. There are ten such similar circuits starting from a circuit connecting terminals m, l0, l′0 through up to a circuit connecting terminals m, l9, l′9.

The terminal m is also connected to a contact g1 of the relay 113, and the contacts g2 and g3 of the relay 113 are connected to a negative terminal and a positive terminal of a d-c power supply. The negative terminal of said d-c power supply is grounded. The terminal m′ is connected to a contact g′1 of the relay 113, and the contacts g′2 and g′3 of the relay 113 are connected to the positive terminal and negative terminal of said d-c power supply. The terminals c′0 to c′9 of the detection control circuit 105 are connected to terminals e0 to e9 of a gate circuit 114, and terminals e′0 to e′9 of the detection control circuit 105 are connected to terminals f0 to f9 of the gate circuit 114. Both ends of monitoring signal lines that also serve as control lines of sensor blocks are connected to the individual elements of vertical and horizontal rows formed by the terminals corresponded to the vertical terminals c0 to c9 and lateral terminals l0 to l9 of the detection control circuit 5. That is, there are a total of 100 sensor blocks, and which sensor blocks are producing alarming can be detected by successively examining which terminals among the terminals c0 to c9 and which terminals among the terminals l0 to l9 are electrically conducted together.

The terminals l0 to l9 (wave forms F0 to F9) of the detection control circuit 105 are also connected to 10 input terminals of an OR gate 116 and to terminals 0 to 9 of a data selector 117 (Ser. No. 74150).

The output $\phi$ (wave form A) of the clock pulse oscillator 101 is also supplied to the input of the AND gate 118. The output terminal (wave form J) of the AND gate 118 is connected to an input terminal of a counter 119 (Ser. No. 7493), and the output terminals of the counter 119 are connected to the input terminals of the data selector 117, demultiplexers 120 and 121 (Ser. No. 74154) as well as to an indicator circuit (not shown). The terminals 0 to 9 of the demultiplexer 121 are connected to the terminals d0 to d9 of the gate circuit 114.

The contents of the gate circuit 114 are illustrated below with reference to a circuit connecting terminals b0, e0, h, and a circuit connecting terminals d0, f0, h. The terminal b0 is connected to an input terminal of an inverter 122, and an output (for example wave form S3 when $C_3$ and $l_2$ are active) of the inverter 122 is connected to an input terminal of an AND gate 123. The other input terminal of the AND gate 123 is connected to the terminal h, and the output terminal of the AND gate 123 is connected to a terminal e0 (for example wave form $T_3$ when $C_3$ and $l_2$ are active). There are ten such similar circuits from a circuit connecting terminals b1, e1, h up through a circuit connecting terminals b9, e9, h.

The terminal d0 is connected to an input terminal of an inverter 124, and an output terminal (wave form U) of the inverter 124 is connected to an input terminal of an AND gate 125. The other input terminal of the AND gate 125 is connected to the terminal h, and an output terminal (wave form V) of the AND gate 125 is connected to the terminal f0. There are ten such similar circuits from a circuit connecting terminals d1, f1, h through up to a circuit connecting terminals d9, f9, h.

A terminal 10 (wave form X) of the demultiplexer 120 is connected to a terminal CLR of a J-K flip-flop 126 (Ser. No. 7472) and to an input terminal of an inverter 127, and an output terminal (wave form Y) of the inverter 127 is connected to a clear terminal of the counter 119. That is, the demultiplexer 120 supplies a reset signal to the J-K flip-flop 126 and to the counter 119. The output terminal (wave form G) of the OR gate 116 is connected to a terminal J of the J-K flip-flop 126, and a terminal $\overline{Q}$ (wave form C) of the J-K flip-flop 126 is connected to the other input terminal of the AND gate 102. The terminal Q (wave form H) of the J-K flip-flop 126 is connected to the other input terminal of the AND gate 118.

Confirmation lines (wave form Q) of sensor blocks are connected to the input terminals of an AND gate 128, and an output terminal (wave form R) of the AND gate 128 is connected to an input terminal of a NOR gate 129. The output terminal (wave form W) of the NOR gate 129 is connected to a terminal CLR of the J-K flip-flop 130 (Ser. No. 7472). The output terminal (wave form K) of the data selector 117 is connected to the input terminal of an inverter 131, and the output terminal (wave form L) of the inverter 131 is connected to the terminal J of the J-K flip-flop 130. A terminal $\overline{Q}$ (wave form M) of the J-K flip-flop 130 is connected to the input terminal of an AND gate 132, input terminal of a timer 133, terminal h of the gate circuit 114, and to a drive terminal of the relay 113. The terminal $\overline{Q}$ (wave form I) of the J-K flip-flop 130 is connected to the other input terminal of the AND gate 118. The output terminal (wave form N) of the timer 133 is connected to the input terminal of the inverter 134, and the output terminal (wave form O) of the inverter 134 is connected to the other input terminal of the AND gate 132. The output terminal (wave form P) of the AND gate 132 is connected to the other input terminal of the NOR gate 129.

The output $\phi_2$ (wave form B) of the clock pulse oscillator 101 which is of the form of pulses having a phase shifted by half cycle from the output $\phi_1$ (wave form A)

which is also of the form of pulses of the clock pulse oscillator 101, is supplied to the terminals CK of the J-K flip-flops 126, 130, to the other input terminal of the AND gate 128, and to the other input terminal of the AND gate 132.

The terminals K of the J-K flip-flops 126, 130, and the other driving terminal of the relay 113 are grounded, and the grounding terminals of various circuits such as clock pulse oscillator 101, AND gate 102, counter 103, demultiplexer 104, and J-K flip-flop 126 are also grounded.

Here, the power-supply feeder circuits connecting to various circuits such as clock-pulse oscillator 101, counter 103, demultiplexer 104, and J-K flip-flop 126, are not illustrated. The increase of the number of circuits will be accompanied by the increase of the number of elements. Under ordinary condition, the aforementioned circuit operates as illustrated below.

The output terminals 0 to 9 of the demultiplexer 104 successively acquires a "low level" (wave forms E0 to E9) according to the number of pulses in synchronism with the output pulses $\phi_1$ (wave form A) of the clock pulse oscillator 101 fed to the counter 103.

In FIG. 6B is illustrated a sensor block 115 in which both ends of a monitoring signal line are connected to the terminals c3 and l2 of the detection control circuit 105.

When the output terminal 3 of the demultiplexer 104 has assumed a "low level", the terminal a3 of the detection control circuit 105 assumes a "low level", rendering the transistor 106 conductive, whereby a voltage is applied to the monitoring signal line of the sensor block 115 in the following manner;

positive terminal of the power supply→contact g3 of the relay 113, →contact g1 of the relay 113→terminal m' of the detection control circuit 105→diode 108→transistor 106→terminal c3 of the detection control circuit 105→terminal of monitoring signal line of the sensor block 115;

negative terminal of the power supply→resistor 111→terminal l2 of the detection control circuit 105→other terminal of the monitoring signal line of the sensor block 115.

Under ordinary condition, the terminals of the monitoring signal lines of the sensor block 115 are not conductive so that the terminal l2 of the detection control circuit 105 assumes a "low level". Further, since the terminals of monitoring signal lines of other sensor blocks connected to the terminal c3 are not conductive, either, the terminals l0 to l9 of the detection control circuit 105 all assume the "low level". Accordingly, the output of the OR gate 116 is of the "low level", and the terminal Q of the J-K flop-flop 126 remains in the "high level", whereby the AND gate 102 feeds pulses to the counter 103 in synchronism with the output pulses $\phi_1$ of the clock pulse oscillator 101. The counter 103 therefore continues the counting operation, and the scanning is effected for other terminals of the detection control circuit 105.

When the sensor has detected fire, the abovesaid circuit operates as described below.

Let it be supposed that a sensor block 115 in which both ends of monitoring signal lines are connected to the detection control terminals c3, l2, has detected fire, and both ends of the monitoring signal lines are rendered conductive. When the terminal 3 of the demultiplexer 104 acquires the "low level", the terminal a3 of the detection control circuit 105 acquires the "low level", rendering the transistor 106 conductive, whereby an electric current flows in the following manner: positive terminal of the power supply contact g3 of the relay 113Δcontact g1 of the relay 113→terminal m' of the detection control circuit 105→diode 108→transistor 106→terminal c3 of the detection control circuit 105→terminals of monitoring signal lines of the sensor block 115→other terminals of the monitoring signal lines of the sensor block 115→terminal l2 of the detection control circuit 105→resistor 111→negative terminal of the power supply. Therefore, the terminal l2 assumes a "high level", and an input of "high level" is fed to the OR gate 116. At this moment, the output (wave form G) of the OR gate 116 assumes a "high level", so that the terminal J of the J-K flip-flop 126 assumes a "high level". Thereafter, at the instant when a pulse of output $\phi_2$ (wave form B) of the clock pulse oscillator 101 is fed to the terminal CK of the J-K flip-flop 126 the state of the J-K flip-flop 126 is reversed causing the terminal Q (wave form H) to be reversed from "low level" into "high level", and the terminal Q (wave form C) to be from "high level" into "low level". Since the terminal Q of the J-K flip-flop 126 is of "low level", i.e., since the input terminal of the AND gate 102 is of "low level", the counter 103 is no longer served with the pulses (wave form D) in synchronism with the output $\phi_1$ of the clock pulse oscillator 101; the counter 103 stops the counting operation. While the counting operation of the counter 103 is stopped, the indicator circuit indicates a vertical line number "3" among the vertical and horizontal lines so that the position of the functioning sensor block can be detected, and the demultiplexer 104 maintains "low level" for the terminal 3 only among the terminals 0 to 9.

Since the terminal Q (wave form H) of the J-K flip-flop 126 is of "high level", i.e., since the input terminal of the AND gate 118 is of "high level", the input terminal (wave form J) of the counter 119 is served with a pulse in synchronism with the output $\phi_1$ of the clock pulse oscillator 101, whereby the counter 119 starts the counting operation. Since only the terminal l2 of the detection control circuit 105, i.e., only the terminal 2 of the data selector 117 is of "high level", the output of the data selector 117 and the terminal W (wave form K) assume "low level" when a third pulse $P'_2$ is introduced to the counter 119, whereby the output (wave form L) of the inverter 131 assumes "high level". Accordingly, the terminal J of the J-K flip-flop 130 assumes "high level", and the state of the J-K flip-flop 130 is reversed at the instant when a pulse of output $\phi_2$ of the clock pulse oscillator 101 is introduced to the terminal CK of the J-K flip-flop 130; therefore, the terminal Q (wave form M) is reversed from "low level" into "high level", and the terminal $\overline{Q}$ (wave form I) is reversed from "high level" into "low level". With the terminal $\overline{Q}$ of the J-K flip-flop 130, i.e., with the input terminal of the AND gate 118 being of "low level", the counter 119 is no longer served with a pulse (wave form J) in synchronism with the output $\phi_1$ of the clock pulse oscillator 101, whereby the counter 119 stops the counting operation. While the counting operation of the counter 119 is stopped, the indicator circuit maintains the indication of a horizontal line number "2" corresponding to the number of pulses fed to the counter 119 among said vertical and lateral lines. That is, while the counting operation of the counter 103 is stopped, the indicator circuit continues to indicate the vertical line number "3", and while the counting operation of the counter 119 is stopped, the indicator circuit continues to indicate the horizontal line number "2", so that the position of the alarming sensor block can be detected thereby to indicate the place of the alarm.

As the terminal Q of the J-K flip-flop 130 is reversed from "low level" to "high level", the timer 133 is actuated, the relay 113 is actuated, and the terminal h of the gate circuit 114 assumes "high level". The counter 103, on the other hand, remains stopped, whereby only the terminal 3 among the terminals 0 to 9 of the demultiplexer 104 assumes "low level", i.e., only the terminal b3 among he terminals b0 to b9 of the gate circuit 114 assumes "low level". The "low level" signal of the terminal b3 is converted into a "high level" signal by the inverter and fed to the input terminal (wave form S3) of the AND gate. The other input terminal of the AND gate is connected to the terminal h, so that the output (wave form T3) of the AND gate is of "high level", i.e., the terminal e3 is of "high level". In this way, among the terminals e0 to e9 of the gate circuit 114, only the terminal e3 is of "high level", or in other words, among the terminals C'0 to c'9 of the detection control circuit 5, only the terminal c'3 is of "high level".

Further, since the counter 119 has been stopped with the third pulse being fed, only the terminal 2 among the terminals 0 to 9 of the demultiplexer 121 is of "low level". That is, among the terminals d0 to d9 of the gate circuit 114, only the terinal d2 is of "low level". The "low level" signal of the terminal d2 is converted into a "high level" signal by the inverter, and fed to the input terminal (wave form U2) of the NAND gate. The other input terminal of the NAND gate is connected to the terminal h, whereby the output terminal (wave form V2) of the NAND gate, i.e., the terminal f2 is of "low level". In this way, among the terminals f0 to f9 of the gate circuit 114, only the terminal f2 is of "low level", i.e., among the terminals l'0 to l'9 of the detection control circuit 105, only the terminal l'2 is of "low level".

In this case, the relay contact is switched by the actuation of the relay 113, and among the contacts c'0 to c'9 of the detection control circuit 105, only the terminal c'3 is assuming "high level", whereby the transistor 107 is rendered conductive. Furthermore, since only the terminal l'2 is of "low level" among the terminals l'0 to l'9, the transistor 110 is also rendered conductive.

An electric current of a direction opposite to that of the electric current when fire is detected, flows in a monitoring signal line that also serves as a control line of the sensor block 115 in the following manner: positive terminal of the power supply→contact g'2 of the relay 113→contact g'1 of the relay 113→terminal m of the detection control circuit 105→diode 112→transistor 110→terminal l2 of the detection control circuit 105→terminal of the monitering signal line of the sensor block 115→terminal of other monitoring signal line of the sensor block 115→terminal c3 of the detection control circuit 105→transistor 107→diode 109→terminal m' of the detection control circuit 105→contact gl of the relay 113→contact g2 of the relay 113→negative terminal of the power supply.

The control unit of the sensor block 115 is actuated by the abovesaid electric current of reversed direction. The operation of the apparatus of the present invention when a confirmation signal for confirming the operation of said control unit is sent from the sensor block 115, and when the confirmation signal is not supplied due to the breakage of the sensor block 115, etc. is described below.

After the control unit of the sensor block 115 has operated, if there is a confirmation signal (wave form Q) by which the confirmation signal line of the sensor block 115 assumes "high level", the AND gate 128 to which will be fed said confirmation signal and the output $\phi_2$ of the clock pulse oscillator 101, produces a pulse (wave form R) in synchronism with the pulses of the output $\phi_2$. The output (wave form W) of the NOR gate 129 to which is fed said pulse, i.e., the terminal CLR which is a clear terminal of the J-K flip-flop 130 instantaneously acquires a "low level", causing the J-K flip-flop 130 to be reset. Owing to this reset, the terminal Q (wave form M) of the J-K flip-flop 130 is reversed from the "high level" to "low level", and the terminal Q (wave form I) is reversed from the "low level" to "high level". The terminal $\overline{Q}$ of the J-K flip-flop 130, i.e., the input terminal of the AND gate 118 assumes "high level", whereby the AND gate 118 produces a pulse (wave form J) to the counter 119 in synchronism with the output $\phi_1$ of the clock pulse oscillator 101, so that the counter 119 starts again the counting operation. The counter 119 which has started the counting operation examines whether there are any terminals acquiring "high level" among other terminals l3 to l9 of the detection control circuit 105. In other words, the counter 119 examines whether there are any alarming places in the aforementioned vertical and lateral lines other than the horizontal line number "2" in the vertical line number "3".

The demultiplexer 120 works to reset the J-K flip-flop 126 and the counter 119. When 11 pulses are fed to the counter 119, the terminal 10 (wave form X) of the demultiplexer 120 produces a signal for resetting the J-K flip-flop 126 to the terminal CLR of the J-K flip-flop 126, and further feeds a reset signal (wave form Y) to the counter 119 via the inverter 127. As the J-K flip-flop 126 is reset, the terminal Q (wave form H) of the J-K flip-flop 126, i.e., the input terminal of the AND gate 118 is reversed from the "high level" to "low level", whereby no pulse is fed to the counter 119; the counter 119 which is being reset stops the counting operation. After the terminal $\overline{Q}$ (wave form C) of the J-K flip-flop 126, i.e., after the input terminal of the AND gate 102 is reversed from the "low level" into the "high level", the output terminal (wave form D) of the AND gate 102 produces a pulse to the counter 103 in synchronism with the pulses of the output $\phi_1$ of the clock pulse oscillator 101, whereby the counter 103 starts again the counting operation. As the counter 103 starts again the counting operation, the terminals 4 to 9 (wave forms E4 to E9) of the demultiplexer 104 successively assumes "low level" thereby to successively scan the other lines of said vertical and horizontal lines to examine whether there are any alarming sensor blocks.

When no confirmation signal appears in the confirmation signal line of the sensor block 115 due to the damage in the sensor block 115 (represented by broken lines in FIG. 7), the timer 133 produces a signal that serves as said confirmation signal. After a predetermined period of time has passed, the output (wave form N) of the timer 133 is changed from the "high level" into the "low level", whereby the output (wave from O) of the inverter 134, i.e., the input terminal of the AND gate 132 is changed from the "low level" into the "high level", causing the AND gate 132 to produce a pulse (wave form P) in synchronism with the pulses of the output $\phi_2$ of the clock pulse oscillator 101. This pulse signal is reversed by the NOR gate 129 (wave form W)

and is supplied as a reset signal to the terminal CLR of the J-K flip-flop 130. After the J-K flip-flop 130 has been reset, the operation is performed in the same manner as in the case when the confirmation signal has appeared.

Figure 8:
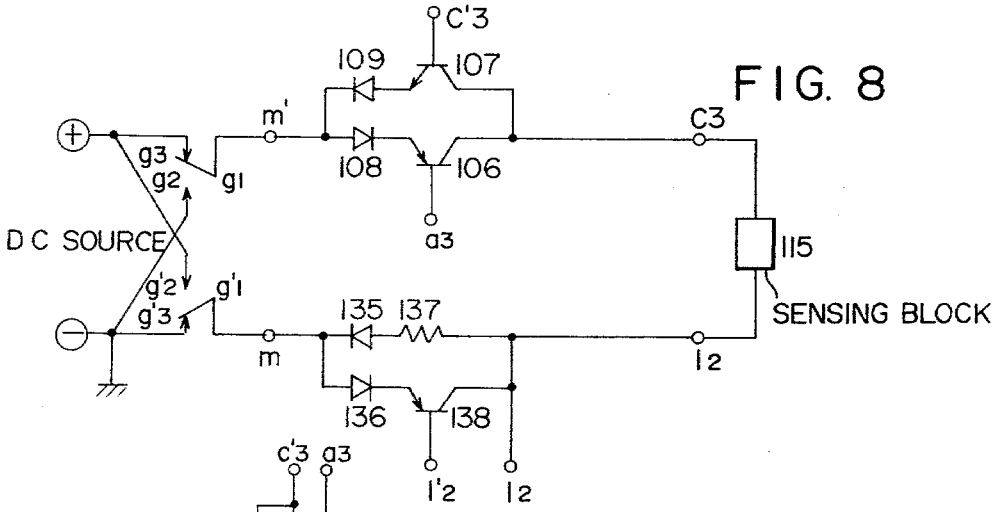
FIG. 8 is a partial circuit diagram showing another embodiment of the polarity-reversing circuit.
Figure 9:
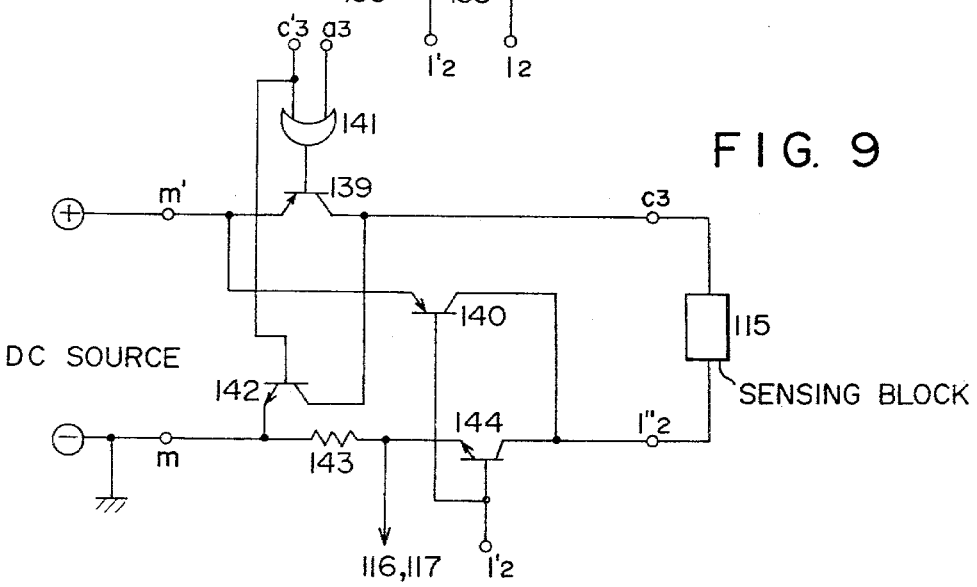
FIG. 9 is a partial circuit diagram showing a further embodiment of the polarity-reversing circuit.
Figure 10:
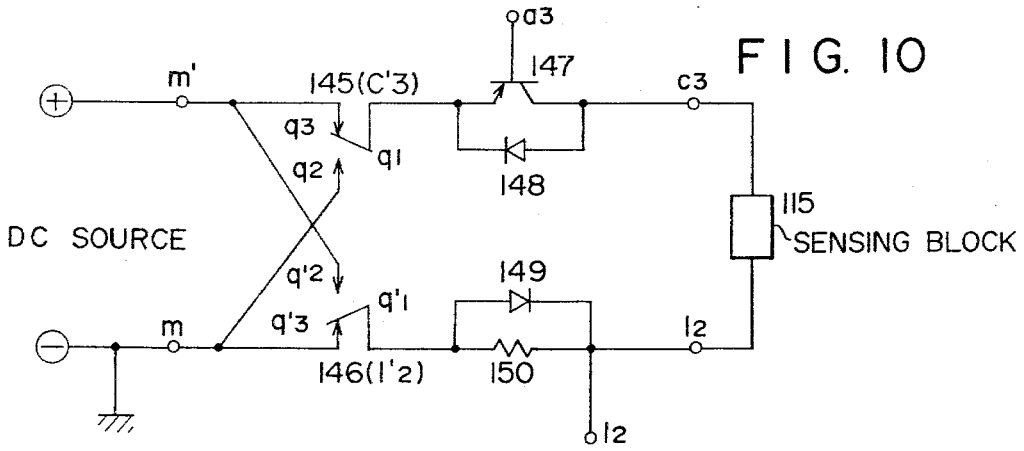
FIG. 10 is a partial circuit diagram showing yet another embodiment of the polarity-reversing circuit.

FIG. 8, FIG. 9 and FIG. 10 show the contents of the detection control circuit 105 of an embodiment of the invention shown in FIG. 6, as well as other embodiments of a polarity-reversing circuit constituted by the circuit connecting the detection control circuit 105 and the power supply. A circuit connected to the sensor block 115 which is connected to the "third" vertical line and "second" horizontal line among said vertical and horizontal lines is described below.

The embodiment shown in FIG. 8 is different from the embodiment of FIG. 6 only in regard to the circuit connecting the terminals, m l'2, l2 of the detection control circuit 105. The terminal m is connected to a diode 135 and to a diode 136, and the other terminal of the diode 135 is connected to a resistor 137. The other terminal of the diode 136 is further connected to the emitter of a transistor 138, and the base of the transistor 138 is connected to the terminal l'2. The other terminal of the resistor 137 and the collector of the transistor 138 are connected to the terminal l2.

When a polarity-reversing signal is introduced, which causes the terminal c'3 to be reversed from the "low level" to "high level" and the terminal l'2 from the "high level" to "low level", the transistor 107 and the transistor 138 are rendered conductive, and the contact of the relay 113 is closed, whereby an electric current flows in the following manner: positive terminal of the power supply→contact g'2 of the relay 113 contact g'1 of the relay 113→terminal m→diode 136→transistor 138→terminal l2→sensor block 115→terminal c3→transistor 107→diode 109→terminal m'→contact g1 of the relay 113→contact g2 of the relay 113→negative terminal of the power supply.

In this way, an electric current of a direction opposite to that of the electric current when fire is detected, flows into the sensor block 115.

In an embodiment shown in FIG. 9, the positive terminal of the power supply is connected to the terminal m', and the negative terminal of the power supply is connected to the terminal m and grounded. The terminal m' is connected to the emitter of a transistor 139 and to the emitter of a transistor 140, and the base of the transistor 139 is connected to the output terminal of the OR gate 141. The collector of the transistor 139 is connected to the collector of a transistor 42 and to the terminal c3. An input terminal of the OR gate 141 is connected to the terminal c'3 and to the base of the transistor 142. The other input terminal of the OR gate 141 is connected to the terminal a3. The terminal m is connected to the emitter of the transistor 142 and to a resistor 143, and the other end of the resistor 143 is connected to the emitter of a transistor 144. The base of the transistor 140 and the base of the transistor 144 are connected to the terminal l'2, while the collector of the transistor 140 and the collector of transistor 144 are connected to a terminal l''2, and the sensor block 115 is connected across said terminal l''2 and the terminal c3. Further, the emitter of the transistor 144 is connected to the terminal 2 of the data selector 117 and to one of the input terminals of the OR gate 116.

As the input level to the terminal 3*a* is changed from the "high level" to the "low level", the transistor 139 is rendered conductive. However, since the terminal l'2 at this moment is assuming "high level", the transistor 144 is conductive, whereby a d-c voltage is applied to the sensor block 115 in the following manner; i.e., positive terminal of the power supply→terminal m'→transistor 139→terminal c3→sensor block 115;

negative terminal of the power supply→terminal m→resistor 143→transistor 144→terminal l''2→sensor block 115.

At this moment, if the sensor block 115 is conductive, the input of "high level" is applied to the terminal 2 of the data selector 117 and to one of the input terminals of the OR gate 116.

If there is a polarity-reversing signal by which the terminal c'3 is reversed from the "low level" to the "high level" and the terminal l'2 is reversed from the "high level" to the "low level", the transistor 139 is rendered non-conductive, the transistor 142 is rendered conductive, the transistor 140 is rendered conductive, and the transistor 144 is rendered nonconductive, whereby an electric current of a direction opposite to that of the electric current when fire is detected flows into the sensor block 115 in the following manner: positive terminal of the power supply→terminal m'→transistor 140→terminal l''2→sensor block 115→terminal c3→transistor 142→terminal m→negative terminal of the power supply.

In an embodiment shown in FIG. 10, the positive terminal of the power supply is connected to the terminal m', the negative terminal of the power supply is connected to the terminal m and is grounded. The terminal m' is connected to a contact q3 of a relay 145 and a contact q'2 of a relay 146, and the terminal m is connected to a contact q2 of the relay 145 and a contact q'3 of the relay 146. The contact q1 of the relay 145 is connected to the emitter of a transistor 147 and to a diode 148, and the contact q'1 of a relay 146 is connected to a diode 149 and to a resistor 150. The base of the transistor 147 is connected to the terminal a3, and the collector of the transistor 147 is connected to the other terminal of the diode 148 and to the terminal c3. The other terminal of the resistor 150 is connected to the other terminal of the diode 149 and to the terminal l2. Both ends of a driving terminal of the relay 145 are connected across the ground and the terminal c'3. Both ends of the driving terminal of the relay 146 are connected across the ground and the terminal l'2.

As the terminal a3 acquires "low level", the transistor 147 is rendered conductive, whereby a d-c voltage is applied to the sensor block 115 in the following manner: positive terminal of the power supply contact q3 of the relay 145→contact q1 of the relay 145→transistor 147→terminal c3→sensor block 115; negative terminal of the power supply terminal m→contact q'3 of the relay 146→contact q'1 of the relay 146→resistor 150→terminal l2→sensor block 115.

If the sensor block 115 is conductive, the terminal l2 is in the "high level".

If there is a polarity-reversing signal which causes the terminal c'3 to be reversed from the "low level" to the "high level", and the terminal l'2 from the "high level" to the "low level", the contacts of the relay 145 and the relay 146 are closed, whereby an electric current of a direction opposite to that of the electric curennt when fire is detected flows into the sensor block 115, in the following manner: positive terminal of the power supply→terminal m'→contact q'2 of the relay 146→contact q'1 of the relay 146→diode 149→terminal l2→sensor block 115 terminal c3→diode 148→contact q1 of the relay 145→contact q2 of the relay 145→terminal m→negative terminal of the power supply.

What is claimed is:

1. Apparatus for monitoring fire and effecting control operation comprising:

a power supply a matrix monitoring signal line network comprising vertical lines and horizontal lines, a plurality of sensing blocks, each connected between one of said vertical lines and one of said horizontal lines of said matrix monitoring network, each of said sensing blocks comprising a sensor connected to said power supply, a monitoring circuit having switch means controlled by said sensor and a first diode of a forward direction connected in series with said switch means between said horizontal line and said vertical line of said matrix monitoring network, and an operation circuit connected in parallel with said monitoring circuit and comprising control means and a second diode of reverse direction connected in series with said control means, signal means controlled by said control means, detection and control circuit means comprising a plurality of switch means, one included in each line of said matrix monitoring network for reversing the polarity of the latter, and operating means connected to respective switch means of said detection and control circuit means for operating said switch means to reverse the polarity of said lines of said matrix monitoring network, scanning means connected to said matrix monitoring network for scanning said network to detect an output produced by said switch means of said monitoring circuit, and means for interrupting scanning and effecting reversal of the polarity of said matrix network to produce an operation when an output of said switch means is detected, and for thereafter restoring normal polarity of said matrix network and resuming scanning.

2. Apparatus for monitoring fire and effecting control operation comprising:

a power supply, a matrix monitoring signal line network comprising vertical lines and horizontal lines, a plurality of sensing blocks each, connected between one of said vertical lines and one of said horizontal lines of said matrix monitoring network, each of said sensing blocks comprising a sensor connected to said power supply, a monitoring circuit having first switch means controlled by said sensor and a first diode of a forward direction connected in series with said first switch means between said vertical line and said horizontal line and an operating circuit connected in parallel with said monitoring circuit between said vertical line and said horizontal line and comprising in series with a second diode of reverse direction, accessory means controlled by said control means and comprising signal indicating means, and detection and control circuit means comprising means for scanning said vertical lines and horizontal lines of said matrix monitoring network to detect a location at which a said vertical line and a said horizontal line are connected by operation of said first switch means under control of the respective sensor, means responsive to said detection for reversing the polarity of said vertical line and said horizontal line to cause current to flow in reverse direction through said second diode and said control means to operate said second switch means and thereby actuate said accessory means to indicate the location of said sensor and temporarily to stop scanning, and means for thereafter restoring normal polarity of said vertical lines and horizontal lines and resuming scanning of said lines.

3. Apparatus according to claim 2, in which said means for restoring normal polarity and resuming scanning comprises timing means operable to restore normal polarity to said vertical and horizontal lines and to resume scanning upon a predetermined elapsed time after operation of said second switch means.

4. Apparatus according to claim 2, in which said scanning means comprises a clock pulse generator, a counter receiving signals from said clock pulse generator and means comprising a demultiplexer receiving output signals of said counter and supplying scanning signal to said matrix monitoring network.

5. Apparatus according to claim 4, in which said detection and control circuit comprises an array of semiconductor switch means controlled by signals from said demultiplexer for supplying power successively to said vertical lines and horizontal lines of said matrix monitoring network.

6. Apparatus according to claim 5, in which said array of semiconductor switch means is operable to reverse the polarity supplied to said lines upon detecting a short circuit produced by the closing of said first switch means under control of the respective sensor.

7. Apparatus according to claim 4, further comprising means including a second counter for supplying numerical information to said indicating means to indicate the location of a said sensor that has been activated to close said first switch means of the respective sensing block.

* * * * *